US008167390B2

(12) United States Patent
Koo et al.

(10) Patent No.: US 8,167,390 B2
(45) Date of Patent: May 1, 2012

(54) INSTALLATION STRUCTURE OF SHELF ASSEMBLY FOR REFRIGERATOR AND REFRIGERATOR COMPRISING THE SAME

(75) Inventors: Bon-Young Koo, Changwon (KR); Jong-Gon Kim, Changwon (KR); Oh-Chul Kwon, Gimhae (KR); Yoo-Min Park, Jinju (KR); Myung-Soo Kim, Gimhae (KR); Young-Hoon Gwak, Busan (KR); Hyeon-Po Cho, Busan (KR)

(73) Assignee: LG Electronics Inc., Seoul (KR)

( * ) Notice: Subject to any disclaimer, the term of this patent is extended or adjusted under 35 U.S.C. 154(b) by 735 days.

(21) Appl. No.: 12/300,101

(22) PCT Filed: Dec. 29, 2006

(86) PCT No.: PCT/KR2006/005897

§ 371 (c)(1),
(2), (4) Date: Nov. 7, 2008

(87) PCT Pub. No.: WO2007/129803

PCT Pub. Date: Nov. 15, 2007

(65) Prior Publication Data

US 2009/0206717 A1 Aug. 20, 2009

(30) Foreign Application Priority Data

May 10, 2006 (KR) ..... 10-2006-0042113

(51) Int. Cl.
*F25D 25/02* (2006.01)
*A47B 88/00* (2006.01)

(52) U.S. Cl. ..... 312/408; 312/333

(58) Field of Classification Search ..... 312/404, 312/408, 410, 350, 351, 330.1, 333, 334.44; 108/107, 110, 143, 106; 211/90.01, 90.02, 211/90.04, 126.15, 150; 62/382
See application file for complete search history.

(56) References Cited

U.S. PATENT DOCUMENTS

| | | | | | |
|---|---|---|---|---|---|
| 1,800,052 | A | * | 4/1931 | Brumbaugh | 126/339 |
| 2,633,400 | A | * | 3/1953 | Ring | 312/410 |
| 3,857,624 | A | * | 12/1974 | Peterson | 312/408 |
| 4,502,741 | A | * | 3/1985 | DeVries et al. | 312/108 |
| 4,904,032 | A | * | 2/1990 | Jenkins | 312/350 |
| 5,273,354 | A | | 12/1993 | Herrmann et al. | |
| 5,642,924 | A | * | 7/1997 | Wohlrab et al. | 312/408 |

(Continued)

FOREIGN PATENT DOCUMENTS

CN 1151508 A 6/1997

(Continued)

*Primary Examiner* — Janet M Wilkens
(74) *Attorney, Agent, or Firm* — Birch, Stewart, Kolasch & Birch, LLP

(57) ABSTRACT

A shelf assembly mounting structure for a refrigerator includes stoppers respectively provided on both sides of a shelf assembly, a plurality of supporting ribs respectively provided on both side surfaces of a storage space, the supporting ribs being formed to extend in a fore and aft direction of the storage space to support a bottom surface of the shelf assembly; and a plurality of guide slots respectively provided in upper surfaces of the supporting ribs, the stopper sliding in the guide slot in a state where the stopper is positioned therein when the shelf assembly is moved in the fore and aft direction of the storage space. The stopper is moved in the fore and aft direction along the guide slot and brought into contact with front and rear ends of the guide slot, whereby a moving distance of the shelf assembly is restricted.

15 Claims, 5 Drawing Sheets

U.S. PATENT DOCUMENTS

| | | | | |
|---|---|---|---|---|
| 5,788,094 | A | 8/1998 | Kim et al. | |
| 5,893,620 | A * | 4/1999 | Birgelis | 312/408 |
| 6,679,573 | B2 * | 1/2004 | Bienick | 312/408 |
| 6,732,662 | B2 * | 5/2004 | Welch et al. | 108/109 |
| 7,188,917 | B2 * | 3/2007 | Bienick | 312/408 |
| 2009/0250420 | A1 * | 10/2009 | Martin et al. | 211/134 |

FOREIGN PATENT DOCUMENTS

| | | | |
|---|---|---|---|
| KR | 20-1999-0021547 | U | 6/1999 |
| KR | 20-1999-0032122 | U | 7/1999 |
| KR | 10-2005-0071184 | A | 7/2005 |
| KR | 2008103348 | * | 11/2008 |

* cited by examiner

INSTALLATION STRUCTURE OF SHELF ASSEMBLY FOR REFRIGERATOR AND REFRIGERATOR COMPRISING THE SAME

TECHNICAL FIELD

The present invention relates to a refrigerator, and more particularly, to a shelf assembly mounting structure for a refrigerator to be detachably installed in a storage space of a refrigerator, and a refrigerator having the same.

BACKGROUND ART

FIG. 9 is a front view showing a refrigerator in which a shelf is mounted by means of a conventional shelf mounting structure for a refrigerator.

As shown in the figure, an interior of a refrigerator body 10 is partitioned into an upper portion and a lower portion as a freezing chamber 11 and a refrigerating chamber 13, respectively. The freezing chamber 11 and the refrigerating chamber 13 are selectively opened and closed by means of a freezing chamber door 11D and a refrigerating chamber door 13D, each of which is installed at the body 10 to pivot on an end of the door so that the other end thereof moves in the fore and aft direction about the one end.

A plurality of shelves 17 are detachably installed in the freezing chamber 11 and the refrigerating chamber 13. Each of the shelves 17 partitions the freezing or refrigerating chamber 11 or 13 into upper and lower portions, and food to be stored in the freezing chamber 11 and the refrigerating chamber 13 is placed on the shelf 17.

A plurality of supporting steps 15 are provided on both side surfaces of the freezing chamber 11 and the refrigerating chamber 13, in which each pair of supporting steps 15 are positioned at the same level as each other. The supporting steps 15 are formed to extend in the fore and aft direction, and both side ends of a bottom surface of the shelf 17 are supported on upper surfaces of the supporting steps 15. In addition, the shelf 17 is moved in the fore and aft direction in a state where both the side ends of the bottom surface of the shelf 17 are supported on the upper surfaces of the supporting steps 15, whereby food placed on the shelf 17 can be more easily put into or taken out of the freezing or refrigerating chamber 11 or 13.

However, the shelf mounting structure for a refrigerator according to the prior art as described above has the problems as follows.

As described above, in a state where both the side ends of the bottom surface of the shelf 17 are supported on the upper surfaces of the supporting steps 15, the shelf 17 is moved in the fore and aft direction, so that the food placed on the shelf can be more easily put into or taken out of the chamber. In the conventional prior art, the shelf 17 is however moved in the fore and aft direction of the freezing or refrigerating chamber 11 or 13 with both the side ends of the bottom surface of the shelf 17 merely supported on the upper surfaces of the supporting steps 15. Accordingly, when the shelf 17 is moved in the fore and aft direction of the freezing or refrigerating chamber 11 or 13, the shelf 17 can be tilted by a weight of the food placed thereon. Thus, there is a problem in that the shelf 17 is inadvertently detached from the storage space or the food placed on the shelf can fall off.

In addition, in a process where the shelf 17 is moved to the rear of the freezing or refrigerating chamber 11 or 13, a user moves excessively the shelf 17 to the rear of the freezing or refrigerating chamber 11 or 13, so that a rear end of the shelf 17 can be brought into close contact with a rear surface of the freezing or refrigerating chamber 11 or 13. Thus, flow of cold air circulating in the freezing or refrigerating chamber 11 or 13 is hindered by the shelf 17, and particularly, the food placed in a rear side of an upper surface of the shelf 17 is not effectively refrigerated or frozen.

DISCLOSURE

Technical Problem

Accordingly, the present invention is conceived to solve the aforementioned problems in the prior art. An object of the present invention is to provide a shelf assembly mounting structure for a refrigerator, which is configured for a shelf to be more stably used, and a refrigerator having the same.

Another object of the present invention is to provide a shelf assembly mounting structure for a refrigerator, in which cold air circulating in a storage space may effectively flow.

Technical Solution

According to an aspect of the present invention for achieving the objects, there is provided a shelf assembly mounting structure for a refrigerator, comprising: stoppers respectively provided both sides of a shelf assembly to be detachably installed in a storage space; a plurality of supporting ribs respectively provided on both side surfaces of the storage space to be vertically spaced apart from each other by a predetermined distance, the supporting ribs being formed to extend in a fore and aft direction of the storage space thus to support both side ends of a bottom surface of the shelf assembly; and a plurality of guide slots respectively provided in upper surfaces of the supporting ribs, the stopper sliding in the guide slot in a state where the stopper is positioned therein when the shelf assembly is moved in the fore and aft direction of the storage space, wherein if the shelf assembly is moved in the fore and aft direction of the storage space, the stopper is moved in the fore and aft direction along the guide slot and brought into contact with front and rear ends of the guide slot, whereby a moving distance of the shelf assembly is restricted.

In one embodiment of the invention, a rear end of the shelf assembly is spaced apart from a rear end of the storage space by a predetermined distance in a state where the stopper is in contact with the rear end of the guide slot.

In another embodiment of the invention, a supporting panel is provided at the rear end of the shelf assembly to protrude upward by a predetermined height to prevent food placed on the shelf assembly from falling off.

In another embodiment of the invention, the stopper protrudes downward from each of both the side ends of the bottom surface of the shelf assembly by a predetermined height, and at least one of front and rear surfaces of the stopper to be brought into contact with the front and rear ends of the guide slot includes an inclined surface for preventing damage generated when the stopper is brought into contact with the front or rear end of the guide slot.

In another embodiment of the invention, the inclined surface of the stopper and the front or rear end of the guide slot are inclined at a predetermined angle so that they are mated with each other.

In another embodiment of the invention, there is further comprising a plurality of guide ribs provided to be spaced apart from the upper surfaces of the supporting ribs by a predetermined distance and formed to extend in the fore and aft direction of the storage space, wherein a movement of the shelf assembly is guided in the fore and aft direction of the storage space by means of a guide channel defined between the upper surface of the supporting rib and a bottom surface of the guide rib.

In another embodiment of the invention, the guide rib is formed integrally with one of the supporting ribs that is positioned directly above another of the supporting ribs on which the shelf assembly is supported.

According to another aspect of the present invention for achieving the objects, there is provided a shelf assembly mounting structure for a refrigerator, comprising: upper stoppers respectively provided both sides of a shelf assembly to be detachably installed in a storage space; a plurality of supporting ribs respectively provided on both side surfaces of the storage space to be vertically spaced apart from each other by a predetermined distance, the supporting ribs being formed to extend in a fore and aft direction of the storage space thus to support both side ends of a bottom surface of the shelf assembly; and a plurality of guide ribs provided to be spaced apart from upper surfaces of the supporting ribs by a predetermined distance and formed to extend in the fore and aft direction of the storage space, wherein when the shelf assembly is moved in the fore and aft direction of the storage space, the upper stopper is brought into contact with a front end of the guide rib, thereby restricting a moving distance of the shelf assembly.

In one embodiment of the invention, in a state where the upper stopper is in contact with the front end of the guide rib, a rear end of the shelf assembly is spaced apart from a rear end of the storage space by a predetermined distance.

In another embodiment of the invention, a supporting panel is provided at the rear end of the shelf assembly to protrude upward by a predetermined height to prevent food placed on the shelf assembly from falling off.

In another embodiment of the invention, the guide rib is formed integrally with one of the supporting ribs that is positioned directly above another of the supporting ribs on which the shelf assembly is supported.

In another embodiment of the invention, the upper stopper protrudes upward from each of both side ends of an upper surface of the shelf assembly by a predetermined height, and a rear surface of the upper stopper to be brought into contact with the front end of the guide rib includes an inclined surface for preventing damage generated when the upper stopper is brought into contact with the front end of the guide rib.

In another embodiment of the invention, the inclined surface of the upper stopper and the front end of the guide slot are inclined at a predetermined angle so that they are mated with each other.

In another embodiment of the invention, there is further comprising lower stoppers respectively provided both the sides of the shelf assembly; and a plurality of guide slots respectively provided in the upper surfaces of the supporting ribs, the lower stopper sliding in the guide slot in a state where the lower stopper is positioned therein when the shelf assembly is moved in the fore and aft direction of the storage space, wherein the lower stopper is moved to the front along the guide slot and brought into contact with a front end of the guide slot when the shelf assembly is moved to the front of the storage space, and the upper stopper is brought into contact with the front end of the guide rib when the shelf assembly is moved to the rear of the storage space, whereby a moving distance of the shelf assembly is restricted.

In another embodiment of the invention, the lower stoppers are formed to protrude outward from one surfaces of shielding ribs for shielding the supporting ribs, the shielding ribs extending downward from locations spaced apart by a predetermined distance inwardly from both the side ends of the bottom surface of the shelf assembly, and front and rear surfaces of the lower stopper to be brought into contact with the front and rear ends of the guide slot includes inclined surfaces for preventing damage generated when the lower stopper is brought into contact with the front and rear ends of the guide slot.

In another embodiment of the invention, the front and rear ends of the guide slot are formed to be inclined at a predetermined angle to be mated with the inclined surfaces of the lower stopper in shape.

According to another aspect of the present invention for achieving the objects, there is provided a refrigerator, comprising: a main body having a predetermined storage space provided therein; a shelf assembly detachably installed in the storage space; and the shelf assembly mounting structure according to any one of claims 1 to 16 for supporting the shelf assembly.

Advantageous Effects

According to the present invention so configured, there is an advantage in that it is possible to stably use the shelf and at the same time cold air can be caused to effectively flow in a storage space.

BEST MODE

Hereinafter, a shelf assembly mounting structure for a refrigerator and a refrigerator having the same according to the preferred embodiment of the present invention will be described in more detail with reference to accompanying drawings.

Figure 1:
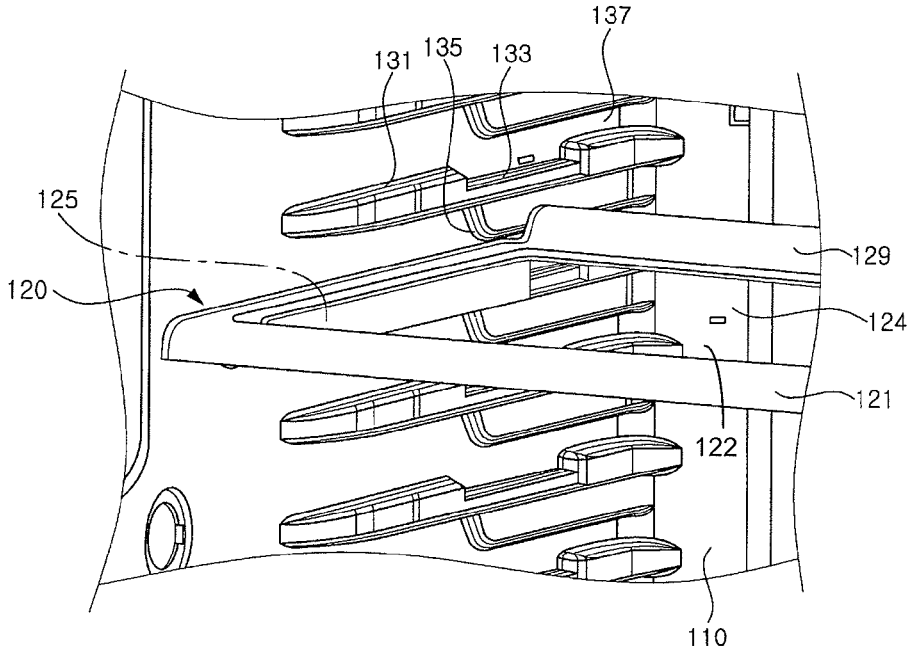
FIG. 1 is a perspective view showing a configuration of a preferred embodiment of a shelf assembly mounting structure for a refrigerator according to the present invention.
Figure 2:
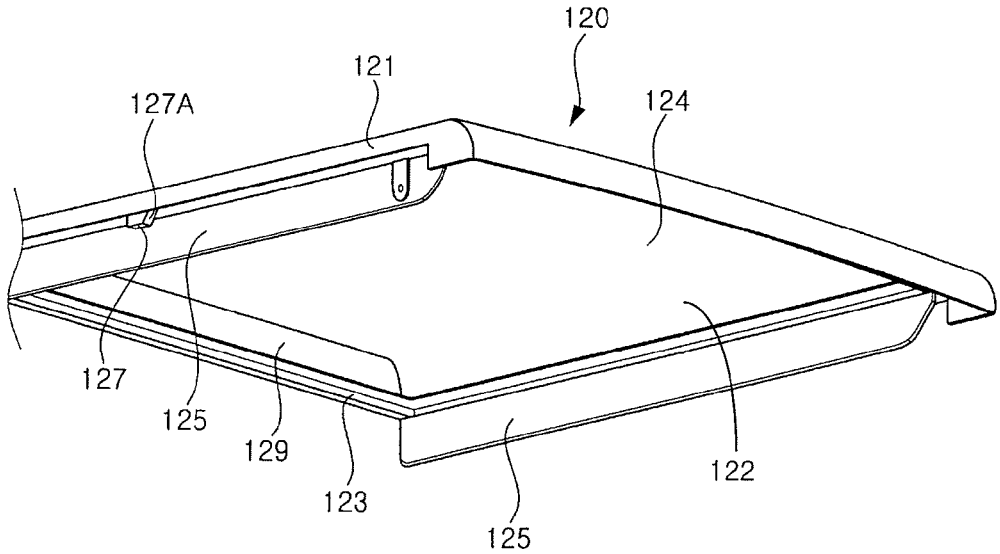
FIG. 2 is a bottom perspective view showing a shelf assembly constituting the embodiment shown in FIG. 1.

FIG. 1 is a perspective view showing a configuration of a preferred embodiment of a shelf assembly mounting structure for a refrigerator according to the present invention, and FIG. 2 is a bottom perspective view showing a shelf assembly constituting the embodiment shown in FIG. 1.

As shown in the figures, a shelf assembly 120 is detachably installed in a storage space 110 defined in a refrigerator. The shelf assembly 120 is installed to be movable in the fore and aft direction of the storage space by a predetermined distance in a state where the shelf assembly is installed in the storage space 110. In addition, a rear end of the shelf assembly 120 is spaced apart from a rear surface of the storage space 110 by a predetermined distance in a state that the shelf assembly is installed in the storage space 110. This allows cold air circulating in the storage space 110 to flow smoothly.

A shelf frame 121 of the shelf assembly 120 is formed in a rectangular shape, and a rectangular through hole 122 is formed to be bored through the shelf frame vertically. In addition, a seating step 123 is provided on a peripheral portion of the through hole 122. The through hole 122 is provided with a support member 124. A peripheral portion of a bottom surface of the support member 124 is placed and supported on an upper surface of the seating step 123.

Also, as shown in FIG. 2, shielding skirts 125 are provided at both sides of a bottom surface of the shelf frame 121, respectively. The shielding skirts 125 extend downwardly from locations which are spaced apart by a predetermined distance inwardly from both side ends of the bottom surface of the shelf frame 121. In a state where the shelf assembly 120 is mounted in the storage space 110, the shielding skirt 125 are adjacent to supporting ribs 131, which will be described below, respectively, so that the shielding skirts serve to prevent the supporting ribs 131 from being exposed to the outside.

Stoppers 127 are provided at both the side ends of the bottom surface of the shelf frame 121 corresponding to outside portions of the shielding skirts 127, respectively. The stoppers 127 slide along guide slots 133, which will be described below, so that the stoppers serve to restrict a moving distance of the shelf assembly 120 which is moved in the fore and aft direction in a state where the shelf assembly 120 is mounted in the storage space 110. The stoppers 127 protrude from both the side ends of the bottom surface of the shelf frame 121, respectively.

In the meantime, a front surface of each of the stoppers 127 is provided with an inclined surface 127A. The front surface of the stopper 127 extends to be downward inclined at a predetermined angle toward the rear side, so that the inclined surface 127A is formed. The inclined surface 127A is to prevent the guide slot 133, particularly, a front end thereof, from being damaged when the stopper 127 slides along the guide slot 133.

In addition, a supporting panel 129 is provided in a rear end of the shelf frame 121. The supporting panel 129 extends by a predetermined distance from the rear end of the shelf frame 121 to be upward inclined. The supporting panel 129 serves to prevent the food placed on the shelf assembly 120 from falling off rearward when the shelf assembly 120 is moved in the fore and aft direction in the storage space 110.

Meanwhile, as shown in FIG. 1, a plurality of supporting ribs 131 are provided on both side surfaces of the storage space 110 to be vertically spaced apart from each other at a predetermined interval and to extend in the fore and aft direction. The supporting ribs 131 protrude by a predetermined width from both the side surfaces of the storage space 110 in the directions opposite to each other. Both the side ends of the bottom surface of the shelf frame 121 are selectively supported on upper surfaces of the supporting ribs 131.

In addition, the guide slot 133 is provided in the upper surface of each of the supporting ribs 131. The guide slot 133 is formed by depressing a portion of the upper surface of the supporting rib 131 downward by a predetermined depth. Accordingly, upper surfaces and opposed side surfaces of the respective guide slots 133 are substantially opened.

The stopper 127 is located in each guide slot 133, so that if the shelf assembly 120 is moved in the fore and aft direction in the storage space 110, the stopper 127 slides along the guide slot 133. In addition, when the shelf assembly 120 is moved in the fore and aft direction in the storage space 110, the inclined surface 127A is brought into contact with a front end of the guide slot 133.

Further, a plurality of guide ribs 135 are provided on both the side surfaces of the storage space 110 at positions corresponding to upsides of the supporting ribs 131, respectively. The guide rib 135 is formed integrally with one of the supporting ribs 131 that is positioned directly above another of the supporting ribs 131 on which the shelf assembly 120 is supported.

The guide ribs 135 are formed to extend in the fore and aft direction of the storage space 110 and protrude from both the side surfaces of the storage space 110 by a predetermined width to face each other. Compared with the front end of the guide slot 133, a front end of the supporting rib 131 is located in the rear of the storage space 110.

A bottom surface of the guide rib 135 is spaced apart by a predetermined distance from the upper surface of the supporting rib 131 positioned directly below the guide rib. Accordingly, a guide channel 137, into which each of both side ends of the shelf assembly 120 is substantially inserted, is formed between the supporting rib 131 and the guide rib 135.

Hereinafter, a moving process of the shelf assembly in the preferred embodiment of the shelf assembly mounting structure for a refrigerator and the refrigerator including the same according to the present invention will be described in more detail with reference to accompanying drawings.

Figure 3:
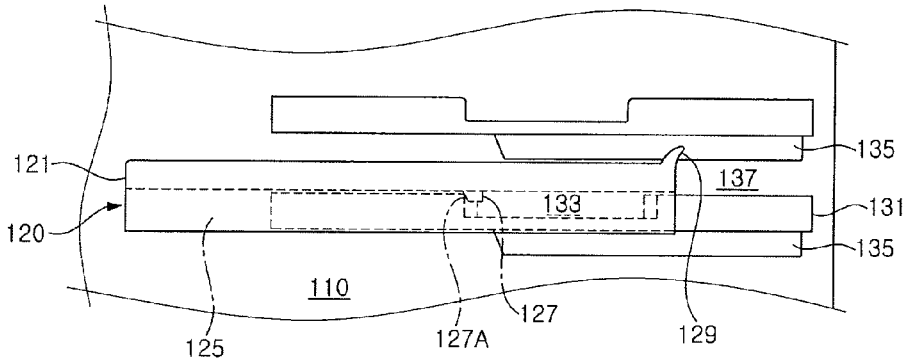
FIGS. 3 and 4 are operational state views showing a moving process of the shelf assembly in the embodiment shown in FIG. 1.
Figure 4:
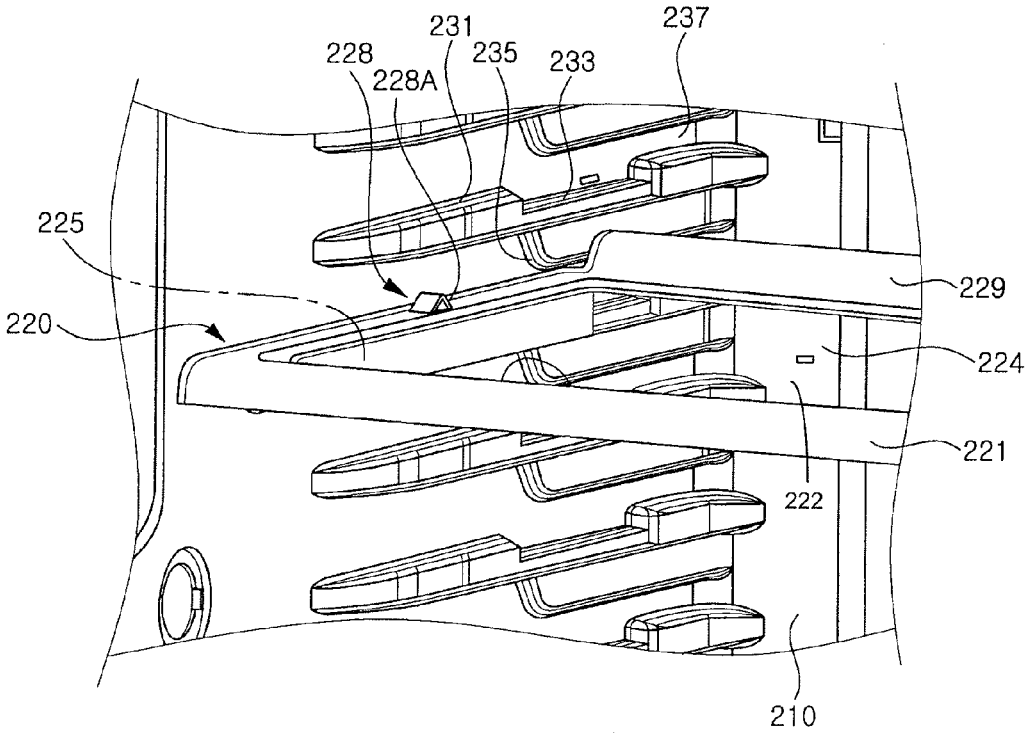

FIGS. 3 and 4 are operational state views showing a moving process of the shelf assembly in the embodiment shown in FIG. 1.

First, as shown in FIG. 3, in order to put or take the food on or out of the shelf assembly 120, the shelf assembly 120 is pulled to the front of the storage space 110. At this time, in a state where both the side ends of the shelf assembly 120 are substantially inserted in the guide channels 137 formed between the supporting ribs 130 and the guide ribs 135, the shelf assembly is moved in the fore and aft direction of the storage space 110 along the guide channel 137. The stoppers 127 also slide to the front of the storage space 110 along the guide slots 133. Then, if the inclined surfaces 127A of the stoppers 127 come into contact with the front ends of the guide slots 133, the shelf assembly 120 does not move to the front of the storage space 110 any more.

In addition, after the food is put on or taken out of the shelf assembly 120, the shelf assembly 120 is pushed to the rear of the storage space 110 as shown in FIG. 4. Accordingly, the stoppers 127 slide to the rear of the storage space 110 along the guide slots 133. Then, if the shelf assembly 120 is continuously moved to the rear of the storage space 110, rear surfaces of the stoppers 127 come into contact with rear ends of the guide slots 133.

Further, if the rear surfaces of the stoppers 127 come into contact with the rear ends of the guide slots 133, the shelf assembly 120 does not move to the rear of the storage space 110 any more. That is, the shelf assembly 120 is mounted in the storage space 110. At this time, the rear end of the shelf assembly 120 is spaced apart from the rear surface of the storage space 110 by a predetermined distance. Accordingly, cold air flows through a space between the rear end of the shelf assembly 120 and the rear surface of the storage space 110, so that the food placed on the shelf assembly 120 can be effectively refrigerated or frozen by means of cold air circulating in the storage space 110.

It will be apparent that those skilled in the art can make various modifications thereto within the technical scope of the present invention. The true scope of the present invention should be defined on the basis of the appended claims.

Mode For Invention

Hereinafter, a shelf assembly mounting structure for a refrigerator and a refrigerator including the same according to another embodiment of the present invention will be described below.

Figure 5:
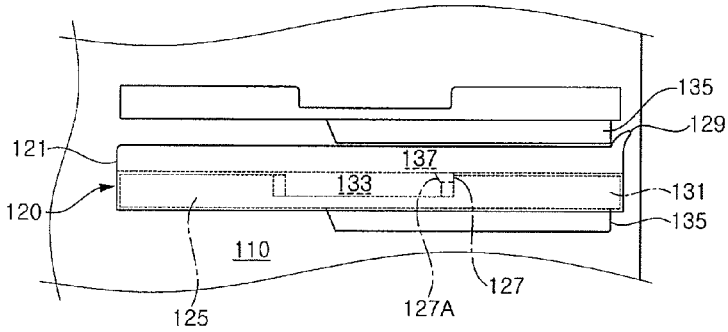
FIG. 5 is a perspective view illustrating a configuration of a shelf assembly mounting structure for a refrigerator according to another embodiment of the present invention.
Figure 6:
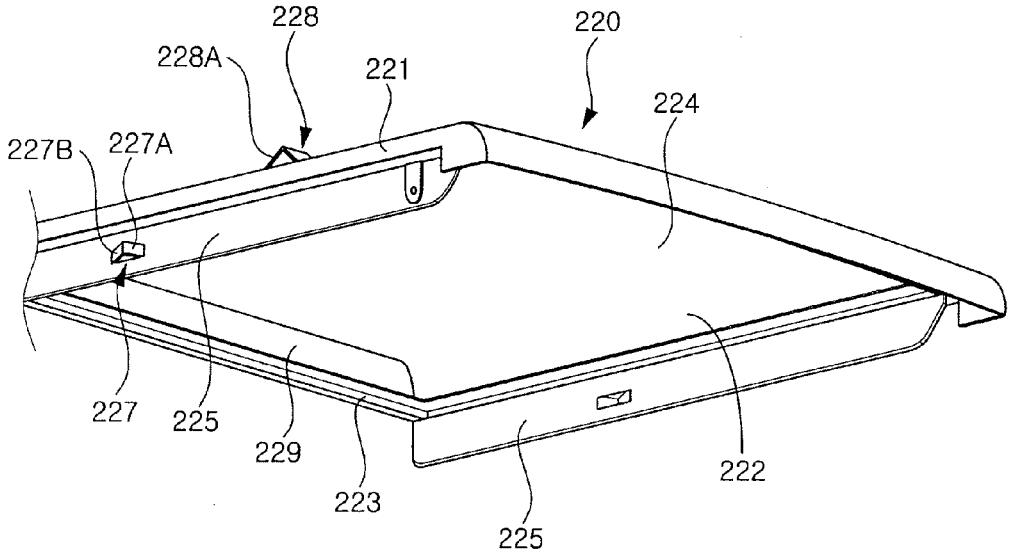
FIG. 6 is a bottom perspective view showing a shelf assembly constituting the embodiment shown in FIG. 5.

FIG. 5 is a perspective view illustrating a configuration of a shelf assembly mounting structure for a refrigerator according to another embodiment of the present invention, and FIG. 6 is a bottom perspective view showing a shelf assembly constituting the embodiment shown in FIG. 5.

As shown in the figures, a shelf assembly 220 is detachably installed in a storage space 210 defined in a refrigerator. The shelf assembly 220 may be moved in the fore and aft direction of the storage space 210 by a predetermined distance in a state where the shelf assembly is installed in the storage space 210. Also, a rear end of the shelf assembly 220 is spaced apart from a rear surface of the storage space 210 by a predetermined distance in order to allow cold air to flow.

A shelf frame 222 of the shelf assembly 220 is formed in an approximately rectangular shape. In addition, a rectangular through hole 223 is formed in the shelf frame 222 and a seating step 223 is formed on a periphery of the through hole 223.

The through hole 223 is provided with a support member 224. The support member 224 is one on which food is placed, wherein a peripheral portion of a lower side of the support member 224 is placed and supported on an upper surface of the seating step 223.

Shielding skirts 225 are provided at both sides of a bottom surface of the shelf assembly 220, respectively. The shielding skirts 225 extend downwardly from locations which are spaced apart by a predetermined distance inwardly from both side ends of the bottom surface of the shelf assembly 220.

As shown in FIG. 6, a lower stopper 227 is provided on one side surface of each of the shielding skirts 225. The respective lower stoppers 227 protrude from side surfaces of the shielding skirts 225 adjacent to side surfaces of the storage space 210 toward the outside, i.e., toward the side surfaces of the storage space 210. In order to restrict a fore and aft movement of the shelf assembly 220 mounted in the storage space 210, the lower stoppers 227 slide along guide slots 231 in a state where the lower stoppers are located in the guide slots 231, which will be described below.

Also, each of the lower stoppers 227 is formed to have a generally triangular cross section, so that front and rear surfaces of the lower stopper 227 include first and second inclined surfaces 227A and 227B. The first and second inclined surfaces 227A and 227B of the lower stopper 227 are to prevent front and rear ends of the guide slot 231 from being damaged when the lower stopper 227 slides along the guide slot 231.

In the meantime, upper stoppers 228 are provided on both side ends of an upper surface of the shelf assembly 220, respectively. The upper stoppers 228 protrude upward from both the side ends of the upper surface of the shelf assembly 220 by a predetermined height. In addition, front and rear surfaces of the upper stopper 228 include inclined surfaces 228A. The rear surface of the upper stopper 228 is downward inclined at a predetermined angle toward the rear, whereby the inclined surface 228A of the upper stopper 228 is formed.

If the shelf assembly 220 is moved to the rear of the storage space 210 in a state where the shelf assembly 220 is mounted in the storage space 210, the inclined surfaces 228A of the upper stoppers 228 comes into contact with guide ribs 235, which will be described below. Accordingly, the inclined surfaces 228A of the upper stoppers 228 serve to prevent the rear ends of the guide slots 233 from being damaged by the second inclined surfaces 227A of the lower stoppers 227 when the shelf assembly 220 is moved to the rear of the storage space 210. To this end, a location of the upper stopper 228 is determined so that if the shelf assembly 220 is moved to the rear of the storage space 210, immediately when or before the second inclined surface 227B of the lower stopper 227 is brought into contact with the rear end of the guide slot 233, the inclined surface 228A of the upper stopper 228 is brought into contact with a front end of the guide rib 235.

A supporting panel 229 is provided at the rear end of the shelf assembly 220. The supporting panel 229 serves to prevent the food placed on the shelf assembly, substantially on the support member 224, from falling off when the shelf assembly 220 is moved in the fore and aft direction in the storage space 210.

In the meantime, a plurality of supporting ribs 231 are provided on both side surfaces of the storage space 210. The supporting ribs 231 is provided on both the side surfaces of the storage space 210 to be vertically spaced apart from each other at a predetermined interval and to extend in the fore and aft direction. In addition, the supporting ribs 231 protrude by a predetermined width from both the side surfaces of the storage space 210 in the directions opposite to each other. Both side ends of a bottom surface of the shelf frame 221 are supported on upper surfaces of the supporting ribs 231.

The guide slot 233 is provided in the upper surface of each of the supporting ribs 231. The guide slot 233 is formed by depressing a portion of the upper surface of the supporting rib 231 downward. The front and rear ends of the guide slot 233 are formed to be inclined at a predetermined angle so as to be mated with the front and rear surfaces of the lower stopper 227 in shape, respectively.

A plurality of guide ribs 235 are provided on both the side surfaces of the storage space 210 at positions corresponding to upsides of the supporting ribs 231, respectively. The guide ribs 235 are provided to be spaced apart upward from upper surfaces of the supporting ribs 231 by a predetermined interval, respectively, and to extend in the fore and aft direction. The guide rib 235 is formed integrally with the supporting rib 131 that is positioned directly above one of the supporting ribs 231 on which the shelf assembly 220 is supported. A front end of the guide rib 235 is formed to be downward inclined at a predetermined angle toward the rear so as to be mated with the rear surface of the upper stopper 228 in shape.

In the meantime, a guide channel 237, in which each of both the side ends of the shelf frame 221 is substantially inserted, is defined between a bottom surface of the guide rib 235 and the upper surface of the supporting rib 231 positioned directly below of the guide rib. Accordingly, it is preferred that a height of the guide channel 237, i.e., a distance between the supporting rib 231 and the guide rib 234 is determined in correspondence to a thickness of the shelf frame 221.

Hereinafter, the operation of the shelf assembly mounting structure for a refrigerator and the refrigerator including the same according to the preferred embodiment of the present invention will be described in detail with reference to accompanying drawings.

Figure 7:
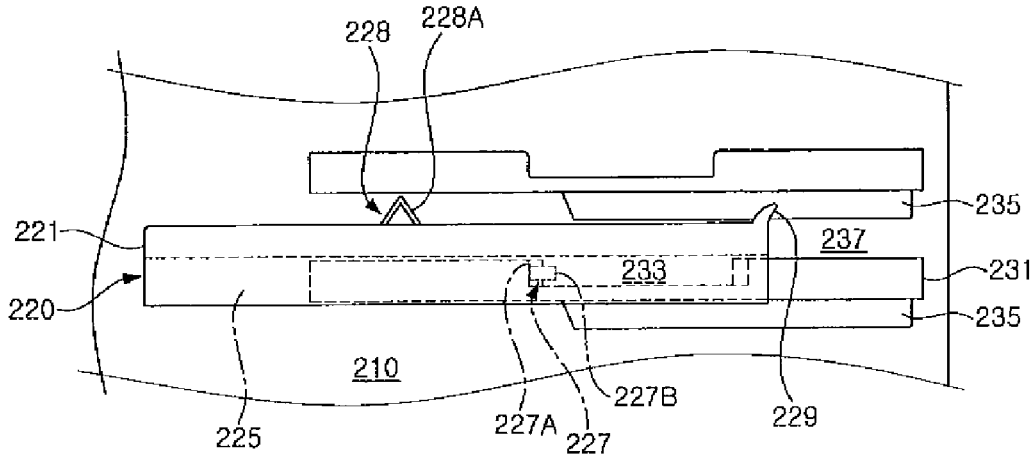
FIG. 7 and FIG. 8 are operational state views showing a moving process of the shelf assembly in the embodiment shown in FIG. 5.
Figure 8:
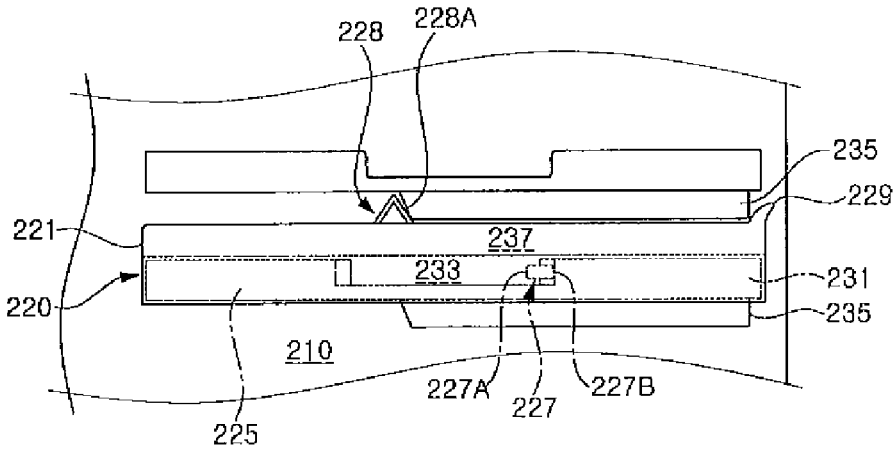
Figure 9:
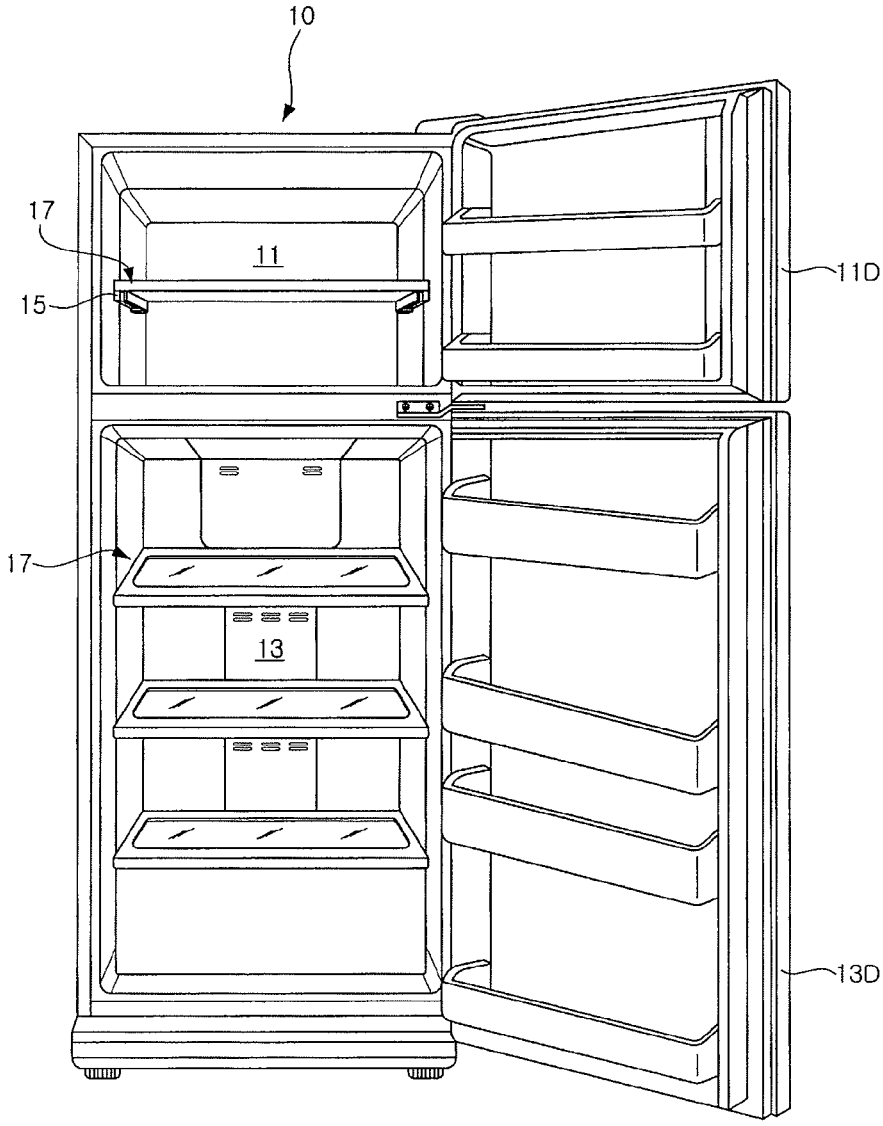
FIG. 9 Prior Art
FIG. 9 is a front view showing a refrigerator in which a shelf is mounted by means of a conventional shelf mounting structure for a refrigerator.

FIGS. 7 and 8 illustrate a moving process of the shelf assembly in the shelf assembly mounting structure for a refrigerator and the refrigerator including the same according to the present invention.

First, as shown in FIG. 7, in order to put or take the food on or out of the shelf assembly 220, the shelf assembly 220 is pulled to the front of the storage space 210. At this time, the lower stoppers 227 slide along the guide slots 233. Then, if the first inclined surfaces 227A of the lower stoppers 227 are brought into contact with the front ends of the guide slots 233, the shelf assembly 220 does not move to the front of the storage space 210 any more.

In the meantime, after the food is put on or taken out of the shelf assembly 220, the shelf assembly 220 is pushed to the rear of the storage space 210 as shown in FIG. 8. At this time, the lower stoppers 227 slide along the guide slots 233.

Then, if the shelf assembly 220 is continuously moved to the rear of the storage space 210, the inclined surfaces 228A of the upper stoppers 228 are brought into contact with the front ends of the guide ribs 235. At this time, the inclined surfaces 228A of the upper stoppers 228 come into contact with the front ends of the guide ribs 235, and at the same time, the second inclined surfaces 227A of the lower stoppers 227 can also be brought into contact with the rear ends of the guide slots 233.

Accordingly, when the second inclined surfaces 227A of the lower stoppers 227 which are relatively invisible to the naked eye of a user are brought into closely contact with the rear ends of the guide slots 233, excessive external force is not applied to the guide slots 233. That is, when the shelf assembly 220 is moved to the rear of the storage 210, it is possible to prevent the lower stoppers 227 from damaging the rear ends of the guide slots 233.

Industrial Applicability

According to the shelf assembly mounting structure for a refrigerator and the refrigerator including the same according to the present invention constituted as described in detail above, the following advantages can be expected.

First, in the present invention, the shelf assembly is substantially moved in the fore and aft direction of the storage space along guide channels formed between the supporting ribs and the guide ribs, and the stoppers moving along the guide slots restrict a moving distance of the shelf assembly. Accordingly, when the shelf assembly is moved in the fore and aft direction of the storage space, the shelf assembly does not escape from a predetermined location inadvertently, whereby it is possible to utilize the shelf assembly more stably.

Further, according to the present invention, in a state where the shelf assembly is mounted in the storage space, the rear surface of the storage space is spaced apart from the rear end of the shelf assembly by a predetermined distance. Accordingly, the flow of cold air circulating in the storage space is not hindered by the shelf assembly, so that the food placed on the shelf assembly can be refrigerated or frozen more effectively.

In addition, in the present invention, there are provided the lower stoppers, which move along the guide slots provided in the upper surfaces of the supporting ribs so as to guide the movement of the shelf assembly and thus are brought into contact with the front and rear ends of the guide slots. Further, the shelf assembly is further provided with the upper stoppers, which are brought into contact with the front ends of the supporting ribs so that immediately when or before the lower stoppers are brought into contact with the rear ends of the guide slots, the lower stoppers are brought into contact with the front ends of the guide ribs and thus a user can more easily distinguish the extent to which the shelf assembly is mounted. Accordingly, when the shelf assembly is moved, it is possible to prevent the lower stoppers from damaging the supporting ribs, so that the durability and appearance of the article are enhanced.

the invention claimed is:

1. A shelf assembly mounting structure for a refrigerator, comprising:

stoppers respectively provided at both sides of a shelf assembly to be detachably installed in the refrigerator;

a plurality of supporting ribs respectively provided on surfaces of opposing inner side walls to be vertically spaced apart from each other by a predetermined distance, the supporting ribs being formed to extend in a fore and aft direction thus to support both side ends of a bottom surface of the shelf assembly; and a plurality of guide slots respectively provided in upper surfaces of the supporting ribs, the stoppers sliding in the guide slots in a state where the stoppers are positioned therein when the shelf assembly is moved in the fore and aft direction, wherein if the shelf assembly is moved in the fore and aft direction, the stoppers are moved in the fore and aft direction along the guide slots and brought into contact with front and rear ends of the guide slots, whereby a moving distance of the shelf assembly is restricted, wherein a rear end of the shelf assembly is spaced apart from a rear inner wall by a predetermined distance in a state where the stoppers are in contact with the rear end of the guide slots, and wherein a supporting panel is provided at the rear end of the shelf assembly to protrude upward by a predetermined height to prevent food placed on the shelf assembly from falling off.

2. The shelf assembly mounting structure as claimed in claim 1, wherein the stoppers protrude downward from each of both the side ends of the bottom surface of the shelf assembly by a predetermined height, and at least one of front and rear surfaces of the stoppers to be brought into contact with the front and rear ends of the guide slots include on inclined surface for preventing damage generated when the stoppers are brought into contact with the front or rear end of the guide slots.

3. The shelf assembly mounting structure as claimed in claim 2, wherein the inclined surface of the stoppers and the front or rear end of the guide slots are inclined at a predetermined angle so that they are mated with each other.

4. The shelf assembly mounting structure as claimed in claim 1, further comprising a plurality of guide ribs provided to be spaced apart from the upper surfaces of the supporting ribs by a predetermined distance and formed to extend in the fore and aft direction, wherein a movement of the shelf assembly is guided in the fore and aft direction by means of a guide channel defined between the upper surface of the supporting rib and a bottom surface of the guide rib.

5. The shelf assembly mounting structure as claimed in claim 4, wherein the guide ribs are respectively formed integrally with one of the supporting ribs that is positioned directly above another of the supporting ribs on which the shelf assembly is supported.

6. A shelf assembly mounting structure for a refrigerator, comprising:

upper stoppers respectively provided at both sides of a shelf assembly to be detachably installed in the refrigerator;

a plurality of supporting ribs respectively provided on surfaces of opposing inner side walls to be vertically spaced apart from each other by a predetermined distance, the supporting ribs being formed to extend in a fore and aft direction thus to support both side ends of a bottom surface of the shelf assembly; and a plurality of guide ribs provided to be spaced apart from upper surfaces of the supporting ribs by a predetermined distance and formed to extend in the fore and aft direction, wherein when the shelf assembly is moved in the fore and aft direction, the upper stoppers are brought into contact with a front end of the guide ribs, thereby restricting a moving distance of the shelf assembly.

7. The shelf assembly mounting structure as claimed in claim 6, wherein in a state where the upper stoppers are in contact with the front end of the guide ribs, a rear end of the shelf assembly is spaced apart from a rear inner wall by a predetermined distance.

8. The shelf assembly mounting structure as claimed in claim 7, wherein a supporting panel is provided at the rear end of the shelf assembly to protrude upward by a predetermined height to prevent food placed on the shelf assembly from falling off.

9. The shelf assembly mounting structure as claimed in claim 6, wherein the guide ribs are respectively formed integrally with one of the supporting ribs that is positioned directly above another of the supporting ribs on which the shelf assembly is supported.

10. The shelf assembly mounting structure as claimed in claim 6, wherein the upper stoppers protrude upward from each of both side ends of an upper surface of the shelf assembly by a predetermined height, and a rear surface of the upper stoppers to be brought into contact with the front end of the guide ribs include an inclined surface for preventing damage generated when the upper stoppers are brought into contact with the front end of the guide ribs.

11. The shelf assembly mounting structure as claimed in claim 10, wherein the inclined surfaces of the upper stoppers and the front end of the guide ribs—are inclined at a predetermined angle so that they are mated with each other.

12. The shelf assembly mounting structure as claimed in claim 6, further comprising:

lower stoppers respectively provided both the sides of the shelf assembly; and a plurality of guide slots respectively provided in the upper surfaces of the supporting ribs, the lower stoppers sliding in the guide slots in a state where the lower stoppers are positioned therein when the shelf assembly is moved in the fore and aft direction, wherein the lower stoppers are moved to the front along the guide slots and brought into contact with a front end of the guide slots when the shelf assembly is moved to the front direction, and the lower stoppers are brought into contact with the front end of the guide slots when the shelf assembly is moved to the front direction, whereby a moving distance of the shelf assembly is restricted.

13. The shelf assembly mounting structure as claimed in claim 12, wherein the lower stoppers are formed to protrude outward from one surfaces of shielding ribs for shielding the supporting ribs, the shielding ribs extending downward from locations spaced apart by a predetermined distance inwardly from both the side ends of the bottom surface of the shelf assembly, and front and rear surfaces of each lower stopper to be brought into contact with the front and rear ends of each guide slot includes inclined surfaces for preventing damage generated when each lower stopper is brought into contact with the front and rear ends of each guide slot.

14. The shelf assembly mounting structure as claimed in claim 13, wherein the front and rear ends of each guide slot are formed to be inclined at a predetermined angle to be mated with the inclined surfaces of each lower stopper in shape.

15. A refrigerator, comprising:

a main body having a predetermined storage space provided therein;

a shelf assembly detachably installed in the storage space; and a shelf assembly mounting structure for supporting the shelf comprising:

stoppers respectively provided at both sides of a shelf assembly to be detachably installed in the storage space;

a plurality of supporting ribs respectively provided on surfaces of the storage space to be vertically spaced apart from each other by a predetermined distance, the supporting ribs being formed to extend in a fore and aft direction of the storage space thus to support both side ends of a bottom surface of the shelf assembly; and a plurality of guide slots respectively provided in upper surfaces of the supporting ribs, the stoppers sliding in the guide slots in a state where the stoppers are positioned therein when the shelf assembly is moved in the fore and aft direction of the storage space, wherein if the shelf assembly is moved in the fore and aft direction, the stoppers are moved in the fore and aft direction along the guide slots and brought into contact with front and rear ends of the guide slots, whereby a moving distance of the shelf assembly is restricted, wherein a rear end of the shelf assembly is spaced apart from a rear end of the storage space by a predetermined distance in a state where the stoppers are in contact with the rear end of the guide slots, and wherein a supporting panel is provided at the rear end of the shelf assembly to protrude upward by a predetermined height to prevent food placed on the shelf assembly from falling off.

* * * * *